United States Patent [19]

Engelbart

[11] Patent Number: 4,753,428

[45] Date of Patent: Jun. 28, 1988

[54] ASSEMBLY FOR POSITIONING PLANAR WORKPIECES WITH RESPECT TO ONE ANOTHER

[75] Inventor: Wilhelm Engelbart, Sylt-Ost, Fed. Rep. of Germany

[73] Assignee: Maschinenfabrik Herbert Meyer KG, Munich, Fed. Rep. of Germany

[21] Appl. No.: 27,825

[22] Filed: Mar. 19, 1987

[30] Foreign Application Priority Data

Mar. 27, 1986 [DE] Fed. Rep. of Germany ..... 3610483

[51] Int. Cl.[4] ..... B65H 39/02

[52] U.S. Cl. ..... 270/58; 112/121.11; 112/121.12; 271/4; 271/10; 271/213; 271/265

[58] Field of Search ..... 270/58, 56; 112/2, 121.11, 112/121.12; 271/4, 9–10, 258, 259, 261, 265, 267, 268, 211, 213, 85, 151

[56] References Cited

U.S. PATENT DOCUMENTS

| | | | |
|---|---|---|---|
| 2,006,071 | 6/1935 | Edwards | 271/151 |
| 3,083,961 | 4/1963 | Arbter . | |
| 3,386,396 | 6/1968 | Jacobs et al. . | |
| 3,544,098 | 12/1970 | Hawley et al. | 270/58 |
| 3,611,957 | 10/1971 | Beazley | 270/58 |
| 3,664,657 | 5/1972 | Hawley et al. | 270/58 |
| 3,945,632 | 3/1976 | Gray . | |
| 3,964,953 | 6/1976 | Mitchard et al. | 270/58 |
| 3,989,235 | 11/1976 | Husges | 270/58 |
| 4,143,871 | 3/1979 | Blessing . | |
| 4,198,041 | 4/1980 | Hughes et al. . | |
| 4,343,255 | 8/1982 | Kelly et al. | 112/121.12 |
| 4,353,539 | 10/1982 | Doyen et al. | 271/10 |
| 4,376,415 | 3/1983 | Willenbacher | 112/121.11 |
| 4,591,139 | 5/1986 | Engelbart . | |
| 4,688,499 | 8/1987 | Moore et al. | 112/121.12 |
| 4,708,333 | 11/1987 | Servl et al. | 270/58 |

FOREIGN PATENT DOCUMENTS

| | | |
|---|---|---|
| 3236677 | 10/1982 | Fed. Rep. of Germany . |
| 8304012 | 11/1983 | Fed. Rep. of Germany . |
| 3436965 | 10/1985 | Fed. Rep. of Germany . |
| 57-25458 | 2/1982 | Japan . |
| 961371 | 5/1963 | United Kingdom . |

OTHER PUBLICATIONS

"Einige Aspekte zur Automatisierung von Teilprozessen in der Konfektion unter besonderer Berücksichtigung des Vereinzelns textiler Flachformgüter," 5th Symposium of the Ready Made Clothing Industrie of East Germany, by Nestler and Schlegel, Nov. 1982.

*Primary Examiner*—Eugene H. Eickholt
*Attorney, Agent, or Firm*—Kenyon & Kenyon

[57] ABSTRACT

In the automation of work operations in the manufacture of apparel, devices for picking up flat workpieces such as fabric pattern pieces comprise a plurality of magazine stations, at each of which is disposed a respective stack of workpieces, and a delivery station arranged in a row with the magazine stations. Each magazine station is assigned a respective separating device which lifts only the uppermost workpiece in the respective workpiece stack on the side thereof facing the delivery station. A foil-like carrier, moved linearly through the stations, travels at a magazine station between the workpiece stack and the workpiece which is lifted on one side and during this travel peels off the workpiece from the workpiece stack.

20 Claims, 1 Drawing Sheet

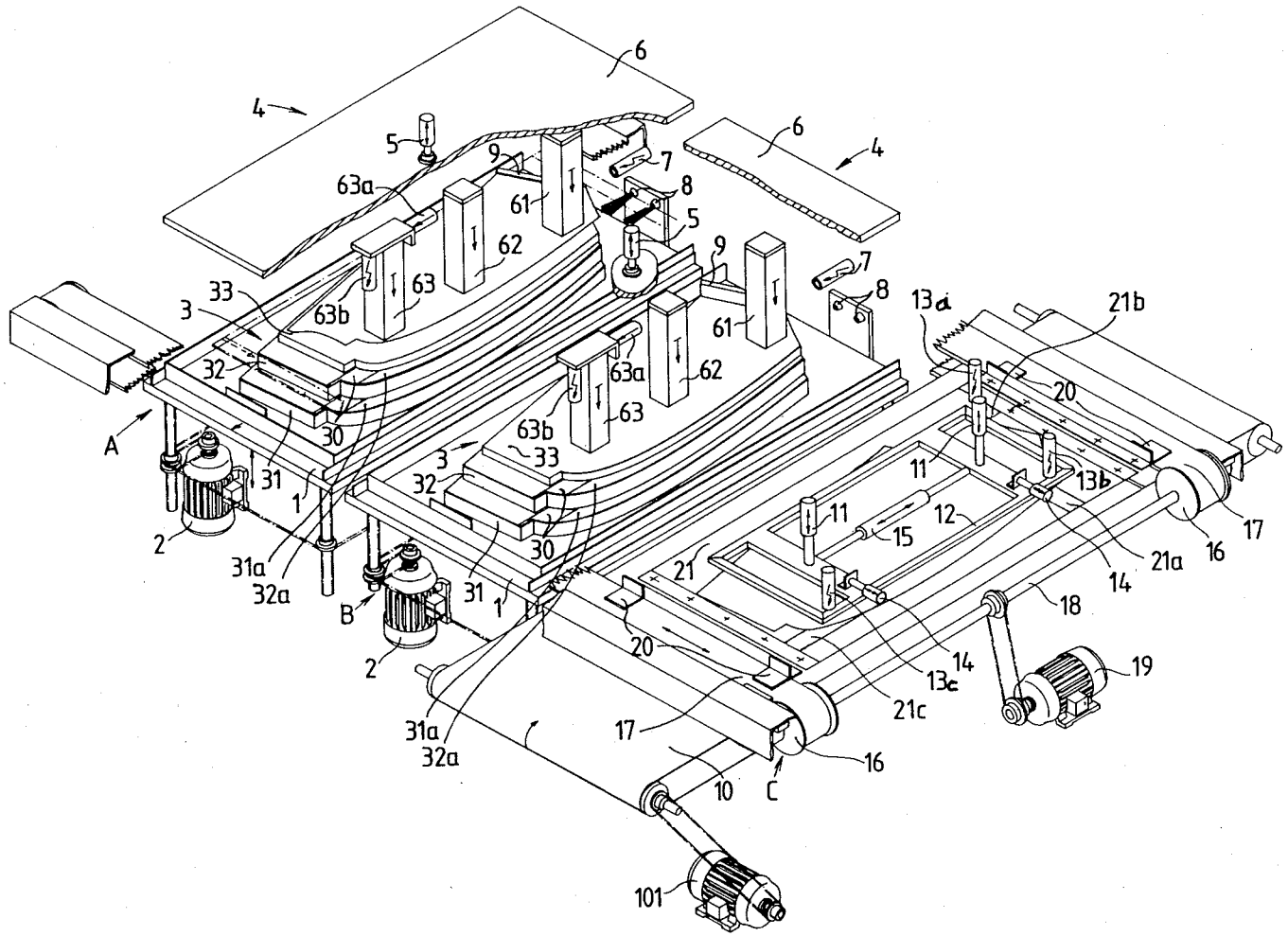
17
16
21a
14
19
21b
13b
18
20
13d
12
14
13e
11
15
21c
16
4
8
7
11
6
61
C
9
62
10
8
5
21
7
63a
63
20
101
6
17
61
63b
33
30
9
62
31
1
3
32
31a
32a
5
63
2
63a
B
63b
30
1
31
31a
32a
4
33
3
32
2
A

ASSEMBLY FOR POSITIONING PLANAR WORKPIECES WITH RESPECT TO ONE ANOTHER

BACKGROUND OF THE INVENTION

This invention relates to an assembly for placing a plurality of planar workpieces such as fabric pattern pieces in predetermined positions with respect to each other. More particularly, this invention relates to such an assembly in which flat workpieces are moved from magazine stations to a delivery station where the workpieces are positioned with respect to each other.

As described in U.S. Pat. No. 3,945,632 and German patent No. 33 36 426, such assemblies are used for automating layout work in the manufacture of apparel. A layout machine of this type can be used, for example, at the input side of a fixing press with which collar inserts are fixed in the manufacture of dress shirts.

There is a substantial interest in continuously improving the operation of automatic layout machines in the apparel industry.

To the extent that layout operations involve large quantities of workpieces having contours and sizes subject to only small changes, effective employment of conventional systems presents only a few difficulties. Considerable difficulties are encountered in the use of such automated layout machinery if the workpieces to be fixed to each other exhibit large differences in contours and/or areas. Such differences must be taken into consideration from lot to lot when setting up the assembly. It is to be noted that the setting-up time required for a transition from one lot to a subsequent one has an extremely adverse effect particularly if the individual lots have relatively small quantities, as is the case with men's and women's apparel.

An object of the present invention is to provide an improved automatic layout machine or assembly of the above-described type.

A more particular object of the present invention is to provide such a machine or assembly in which the transition from one lot of workpieces to another lot of workpieces of different size and shape is accomplished with an extremely small resetting time.

Another, more general, object of the present invention is to provide such a machine or assembly in which efficiency is enhanced.

SUMMARY OF THE INVENTION

Pursuant to the present invention, an assembly for placing a plurality of planar workpieces in predetermined positions with respect to each other comprises a first support including a first lifting table at a first magazine station for supporting a first stack of a plurality of first planar workpieces and a second support including a second lifting table at a second magazine station for supporting a second stack of a plurality of second planar workpieces. A first automatically operating separating device is disposed at least in part at the first magazine station for separating an uppermost one of the first planar workpieces from the first stack. A second automatically operating separating device is disposed at least in part at the second magazine station for separating an uppermost one of the second planar workpieces from the second stack. A laying table is disposed at a delivery station for receiving one of the first planar workpieces separated from a top of the first stack and one of the second planar workpieces separated from a top of the second stack and for supporting the received workpieces during a positioning operation. The delivery station and the magazine stations are disposed in a linear configuration.

The assembly further comprises a carrier device for alternately moving a separated one of the first planar workpieces from the first magazine station to the delivery station and a separated one of the second planar workpieces from the second magazine station to the delivery station. The carrier device includes a foil member with a sliding surface, the foil member being shiftably disposed for motion between adjacent ones of the delivery station and the magazine stations along the linear configuration of the stations. A sliding frame disposed at the delivery station over the laying table is provided as a component of the assembly for positioning, on the laying table, workpieces deposited at the delivery station by the carrier, the sliding frame being shiftable both in a direction parallel to the laying table and in a direction perpendicular thereto.

Pursuant to other features of the present invention, at least one of the first separating device and the second separating device includes a lifting plate disposed over the respective workpiece stack at the respective magazine station, that separating device being provided on a downwardly facing side with a plurality of spaced finger-shaped gripper members. The gripper members are advantageously aligned with one another along a side of the stack facing towards the delivery station, while at least one of the gripper members is adjustably disposed with respect to the lifting plate so that that gripper member is shiftable along a line defined by the gripper members.

Pursuant to another feature of the present invention, the separating device with the lifting plate further includes at least one air nozzle for ejecting an air stream laterally towards the respective workpiece stack to facilitate a separating of an uppermost workpiece in the stack.

Pursuant to yet another feature of the present invention, the workpiece stack associated with the separating device having a lifting plate comprises several substacks of workpieces all having a similar contour. In addition, workpieces in each of the substacks have a common size different from sizes of the workpieces in the other substacks, while the workpieces in any given one of the substacks have a size smaller than the sizes of workpieces in substacks disposed below the given substack and a size larger than the sizes of workpieces in substacks disposed above the given substack. Advantageously, all of the workpieces in the substacks have a like edge engaging a common stop, the adjustably disposed gripper member being disposed at a distance from the stop greater than distances at which the other gripper members are disposed with respect to the stop.

Pursuant to another, particular, feature of the present invention, each of the substacks is covered with a respective template having a contour identical to the contour of the respective substack and further having on an upper surface an at least partially light reflective region. The assembly further comprises a light scanning device disposed on the adjustably disposed gripper member, the light scanning device being mounted to direct a beam of light downwardly onto the respective workpiece stack.

In accordance with a further feature of the present invention, the positioning means includes several fixed light scanners disposed to respective direct beams of light downwardly towards the laying table, the foil member being provided on an upwardly facing side with a plurality of at least partially light reflective regions each cofunctioning with a respective fixed light scanner. A control device is operatively connected to the light scanners and the sliding frame for controlling the motion thereof in response to output signals from the light scanners.

In accordance with further particular features of the present invention, the laying table comprises a conveyor belt having a direction of transport oriented substantially perpendicularly with respect to the linear configuration of the magazine stations and the delivery station, whereas the carrier includes a pair of endless driving belts extending parallel to the linear station arrangement or configuration. The foil member is preferably stretched between the two belts transversely to the linear station configuration, the two belts being mounted to respective deflection rolls and moved synchronously over the respective deflection rolls by a common drive.

Advantageously, the assembly further comprises means connected to at least one of the first lifting table and the second lifting table for adjusting the vertical position thereof so that the uppermost workpiece in the respective one of the first stack and the second stack is disposed in a predetermined plane.

The invention is based on the insight that in separating an uppermost workpiece from a workpiece stack it is sufficient to lift the uppermost workpiece on one side and then to peel off that workpiece from the stack by means of a foil-like carrier with a sliding surface, thereby utilizing the gap opening between the uppermost workpiece and the workpiece stack. The foil-like carrier is preferably stretched and may take the form of a polytetrafluoroethylene web. Accordingly, the workpiece grippers on the separating device need be aligned only along the one edge where the gap is initially created between the uppermost workpiece and the rest of the stack. Such a method of separating a workpiece from the top of a stack can be implemented very quickly and simply in the event of a change in lot.

In conventional separating devices, such as that described in German patent No. 33 36 4226, a workpiece is separated from a stack by completely lifting the workpiece by means of a large number of grippers which engage the workpiece uniformly at the circumference and in the central region of the workpiece. In the event of a change in lot, where the new workpieces differ in size as well in shape from the workpieces previously handled, most workpiece grippers must as a rule then be realigned with respect to the new contour area, which realignment requires a considerable amount of time. In an assembly for placing a plurality of planar workpieces in predetermined positions with respect to each other, in accordance with the present invention, the time for preparing the workpiece grippers for a change in lot is substantially reduced in comparison with conventional layout machines.

Another advantage of a layout machine or assembly in accordance with the present invention is that the simple back-and-forth motion of the carrier between the magazine stations and the delivery station enables a substantially faster delivery operation then is possible in a conventional layout machine having a lifting device fastened to a carriage.

BRIEF DESCRIPTION OF THE DRAWING

The sole FIGURE of the drawing is a perspective view of a layout machine or assembly in accordance with the present invention.

DETAILED DESCRIPTION

In the drawing FIGURE, reference characters A and B designate two magazine stations while reference character C corresponds to a delivery station. Each magazine station A and B comprises a lifting table 1 with a spindle transmission 2 for effectuatinq a height adjustment. Each lifting table 1 supports a workpiece stack 3 with three substacks 31, 32 and 33. Substacks 31, 32 and 33 are arranged on top of each other according to size so that the smallest substack 33 is the topmost substack.

Magazine stations A and B each have a separating device 4 disposed above the respective lifting table 1 and above the workpiece stacks deposited thereon. Separating device 4 comprises a shiftable lifting plate 6 having a vertical position adjustable by a lifting cylinder 5. On the bottom side of lifting plate 4 are provided finger-shaped workpiece grippers 61, 62 and 63. Grippers 61, 62 and 63 are mounted to lifting plate 6 so that they are aliqned along the edge of the workpieces of stack 3 on the side of the stack facing delivery station C.

Spindle drive 2 of each magazine station A and B is controlled via a respective light scanner 7 to locate the uppermost workpiece of the respective stack 3 always in a predetermined removal plane, independently of the height of the workpiece stack. In the removal plane are further provided on the rear of lifting table 1 of each magazine station A and B two air blasting nozzles 8 which eject an air stream to facilitate the separation of a workpiece from workpiece stack 3.

Substacks 31, 32 and 33 are stacked on top of each other in such a way that like edges of the substacks (rear edges in the drawing FIGURE) engage a stop 9 in the form of a strip fastened to the rear edge of lifting table 1. The workpiece gripper 63 which is farthest removed from this stop 9 is adjustably mounted to lifting plate 6 via a drive **63*a*. For controlling drive 63*a*, workpiece gripper 63 carries a light scanner 63*b* which, upon a change from one substack to the next, causes a forward movement of the gripper 63 until a light beam, generated by light scanner 63*a* and directed downwardly onto the workpiece stack 3, is reflected. That reflection is made possible by the disposition on each of the substacks 31 and 32 of a respective covering template 31*a* and 32*a* matched to the contours and area of the workpieces of the associated substack and having on an upper side, along the edge and below the adjustable workpiece gripper 63, a light-reflecting region 30 formed by a cemented-on reflecting foil. The uppermost substack 33**, which is already partly worked up on the drawing, understandably does not bear the template originally covering that substack.

At delivery station C is located a deposition table in the form of a conveyor belt 10 with a transport direction oriented perpendicularly to the row of stations A, B and C. Above conveyor belt 10, a sliding frame 12 is fastened to lifting cylinders 11 in turn attached to an assembly frame (not shown). In addition, three light scanners **13*a*, 13*b* and 13*c* are firmly mounted in a suitable relative arrangement to the assembly frame for controlling the positioning of workpieces to be deposited on conveyor belt 10. Light scanners 13*a*, 13*b* and 13*c* produce respective light beams directed downwardly onto conveyor belt 10. Sliding frame 12 further comprises stations arranged in tandem for its sliding motion and, in the direction perpendicular thereto, drives 14 and 15 controlled by light scanners 13***a*, 13*b*, 13*c*.

Parallel to the row or linear configuration of stations A, B and C and on each side thereof, an endless driving belt 17 is provided which is guided over respective deflection rolls 16. Driving belts 17 are moved jointly by a drive 19 via a shaft 18 which connects deflection rolls 16 of driving belts 17 to each other. Between driving belts 17, a foil-like carrier 21 is stretched via holders 20 over the entire width of stations A, B and C, and more specifically at the height of the removal plane in the region of magazine stations A and B. Carrier 21 can be moved between the different stations via driving belts 17 and is provided with light-reflective subareas or regions 21*a*, 21*b* and 21*c* used in the control of drives 14 and 15 of sliding frame 12 by light scanners 13*a*, 13*b* and 13*c*. Light-reflective regions 21*a*, 21*b* and 21*c* are located in their moved position above conveyor belt 10 in the vicinity of the light beams generated by light scanners 13*a*, 13*b* and 13*c*, respectively.

The operation of a layout machine or assembly according to the invention will now be described in detail, reference being made to a description of operating cycles following each other in a laying operation.

In this connection it will be assumed that workpiece stack 3 disposed at magazine station A consists of stacked outer cloth parts which have been cut in a conventional manner so that, in successive workpieces in the stack, the same sides of the cloth rest against each other. The same convention applies with respect to the workpiece stack at magazine station B, which stack consists of inserts corresponding to the outer cloth parts in the workpiece stack at magazine station A. It will further be assumed that the templates which cover the uppermost substacks 33 have already been removed at both magazine stations A and B and that light scanners 63*b* of workpiece grippers 63 have aligned those grippers over the light reflecting subareas or regions on the middle substacks. At the beginning of the laying operation, the uppermost workpiece of substack 33 in the magazine station A lies with its outer cloth side facing downwards, while the uppermost workpiece at magazine station B is disposed with its side having the adhesive dot pattern facing upwards.

First, carrier 21 is moved past magazine station B to magazine station A. The uppermost workpiece at station A is simultaneously grabbed by workpiece grippers 61, 62 and 63 upon a lowering of lifting plate 6 to the workpiece stack 3. At the seized edge of the uppermost workpiece, an opening slot or gap is created between the uppermost workpiece and the workpiece stack for the insertion of carrier 21. The gap is created by raising lifting plate 6 while at the same time activating blasting nozzles 8. Carrier 21 subsequently travels into this opening slot to a terminal position at magazine station A, and in the process peels the uppermost workpiece off of the workpiece stack at station A.

Then, lifting plate 6 together with associated workpiece grippers 61, 62 and 63 at magazine station A again descends. In the process, workpiece grippers 61, 62 and 63 are separated from the uppermost, now separated, workpiece, under pressure exerted on the workpiece by carrier 21. Lifting plate 6 with workpiece grippers 61, 62 and 63 subsequently ascends again.

In a following phase of the initial operating cycle, carrier 21 moves with the workpiece separated from workpiece stack 3 at magazine station A towards a terminal position above conveyor belt 10 at delivery station C. As soon as carrier 21 has reached that terminal position, sliding frame 12 is lowered onto the workpiece and moves it in accordance with control signals from light scanners 13*a*, 13*b* and 13*c* into a predetermined position determined in part by light-reflecting subareas 21*a*, 21*b* and 21*c*.

Lifting plate 6 at magazine station B is then lowered with its workpiece grippers 61, 62 and 63 onto the respective workpiece stack and lifts the uppermost workpiece on the side thereof facing delivery station C with the aid of air ejected by blasting nozzles 8 at station B. As carrier 21 moves again toward magazine station B, the workpiece held at the underside of sliding frame 12 is stripped off of carrier 21 and is deposited on conveyor belt 10 in the predetermined position. Subsequently, sliding frame 12 returns to its raised starting position, while carrier 21 in turn enters the opening or gap between the lifted uppermost insert piece and the rest of the workpiece stack at magazine station B and peels that workpiece from the stack. After workpiece grippers 61, 62 and 63 have been separated from the peeled-off workpiece, as heretofore described in connection with magazine station A, carrier 21 travels with the insert piece to conveyor belt 10 at delivery station C, whereupon the cycle with sliding frame 12 starts anew.

Another insert piece is then fetched from the workpiece stack at magazine station B by means of carrier 21, as set forth above, and subsequently, a workpiece is peeled off of the stack at magazine station A and is deposited in a predetermined position exactly on top of the second insert piece from station B. The sandwich put together by the operations in accordance with the foregoing description is now transported via conveyor belt 10 to another processing station, while carrier 21 proceeds to magazine station A in order to fetch therefrom a first workpiece for putting together a further sandwich. The next processing station may exemplarily be a manual station where further laying work is performed on the sandwich.

As soon as substacks 33 in magazine stations A and B have been worked off, movable workpiece gripper 63 is repositioned or moved in the forward direction until the associated light scanner 63*a* receives its own reflected light. The templates are subsequently removed from the tops of substacks 32 in the same manner as the workpieces, are deposited on top of each other on conveyor belt 10 and are then removed from the belt at the next work station.

The automatic positioning of the separated workpieces on carrier 21 above conveyor belt 10 at delivery station C by means of light scanners 13*a*, 13*b* and 13*c* in cooperation with light-reflecting regions 21*a*, 21*b* and 21*c* is accomplished by first moving sliding frame 12 via its drive 15 to carry the workpiece in the direction toward the rear until light scanner 13*b* no longer receives its own reflected light. Subsequently, drives 14 are activated by the light scanners 13*a* and 13*c* and sliding frame 12 is moved to the right until light scanners 13*a* and 13*c* no longer receive their own reflected light. In this simple manner, positioning of the workpieces to be stacked together can be accomplished with an accuracy in the millimeter range.

Finger-shaped workpiece grippers 61, 62 and 63 are advantageously designed as adhesive-tape pickups, as described in detail in German patent No. 33 36 426.

Foil-like carrier 21 can take widely different forms. Besides a stretched foil such as a teflon web, it can alternatively consist of a thin steel sheet or an elastic synthetic resin plate with one or more layers.

In the embodiment example shown in the drawing, conveyor belt 10 has a direction of transport extending perpendicularly to the direction of motion of foil-like carrier 21. If required, conveyor belt 10 can, of course, have its transport direction oriented in the direction of motion of carrier 21.

A layout machine or assembly according to the invention can be employed to advantage wherever flat or planar workpieces are to be deposited on top of each other automatically and wherever, in the processing of small lots of workpieces of different sizes and shapes, especially short machine resetting times for the efficient use of such layout machines are important. A preferred field of application is the manufacture of men's and ladies' apparel.

What is claimed is:

1. An assembly for placing a plurality of planar workpieces in predetermined positions with respect to each other, said assembly comprising:

first support means including a first lifting table at a first magazine station for supporting a first stack of a plurality of first planar workpieces;

second support means including a second lifting table at a second magazine station for supporting a second stack of a plurality of second planar workpieces;

first separating means including a first automatically operating separating device disposed at least in part at said first magazine station for separating an uppermost one of said first planar workpieces from said first stack;

second separating means including a second automatically operating separating device disposed at least in part at said second magazine station for separating an uppermost one of said second planar workpieces from said second stack;

receiving means including a laying table disposed at a delivery station for receiving one of said first planar workpieces separated from a top of said first stack and one of said second planar workpieces separated from a top of said second stack and for supporting the received workpieces during a positioning operation, said delivery station and said magazine stations being disposed in a linear configuration;

carrier means, including a foil member shiftably disposed for motion between adjacent ones of said delivery station and said magazine stations along said linear configuration, for alternately moving a separated one of said first planar workpieces from said first magazine station to said delivery station and a separated one of said second planar workpieces from said second magazine station to said delivery station, said foil having a sliding surface; and positioning means including a sliding frame disposed at said delivery station over said laying table for positioning on said laying table workpieces deposited at said delivery station by said carrier means, said sliding frame being shiftable both in a direction parallel to said laying table and in a direction perpendicular thereto.

2. The assembly defined in claim 1 wherein at least one of said first separating device and said second separating device includes a lifting plate disposed over the respective one of said first stack and said second stack at the respective one of said first magazine station and said second magazine station, said one of said first separating device and said second separating device being provided on a downwardly facing side with a plurality of spaced finger-shaped gripper members.

3. The assembly defined in claim 2 wherein said one of said first separating device and said second separating device further includes means comprising at least one air nozzle for ejecting an air stream laterally towards said respective one of said first stack and said second stack to facilitate a separating of an uppermost workpiece in said respective one of said first stack and said second stack.

4. The assembly defined in claim 3 wherein said gripper members are aligned with one another along a side of said respective one of said first stack and said second stack facing towards said delivery station.

5. The assembly defined in claim 4 wherein at least one of said gripper members is adjustably disposed with respect to said lifting plate.

6. The assembly defined in claim 5 wherein said one of said gripper members is shiftable along a line defined by said gripper members.

7. The assembly defined in claim 5 wherein said respective one of said first stack and said second stack comprises several substacks of workpieces all have a similar contour, workpieces in each of said substacks having a common size different from sizes of the workpieces in other ones of said substacks, the workpieces in any given one of said substacks having a size smaller than the sizes of workpieces in substacks disposed below said given one of said substacks and a size larger than the sizes of workpieces in substacks disposed above said given one of said substacks, all of the workpieces in said substacks having a like edge engaging a common stop, said one of said gripper members being disposed at a distance from said stop greater than distances at which others of said gripper members are disposed with respect to said stop.

8. The assembly defined in claim 7 wherein each of said substacks is covered with a respective template having a contour identical to the contour of the respective substack and further having on an upper surface an at least partially light reflective region, further comprising a light scanning device disposed on said one of said gripper members, said light scanning device being mounted to direct a beam of light downwardly onto said respective one of said first stack and said second stack.

9. The assembly defined in claim 1 wherein said sliding frame is provided on a downwardly facing side with a rough surface.

10. The assembly defined in claim 9 wherein said rough surface comprises a layer of felt attached to said sliding frame.

11. The assembly defined in claim 1 wherein said positioning means includes several fixed light scanners disposed to direct a beam of light downwardly towards said laying table, said foil member being provided on an upwardly facing side with a plurality of at least partially light reflective regions, said positioning means including control means operatively connected to said light scanners and said sliding frame for controlling the motion thereof in response to output signals from said light scanners.

12. The assembly defined in claim 1 wherein said laying table comprises a conveyor belt having a direction of transport oriented substantially perpendicularly with respeect to said linear configuration.

13. The assembly defined in claim 1 wherein said carrier means includes a pair of endless driving belts extending parallel to said linear configuration, said foil member being stretched between said two belts transversely to said linear configuration, said two belts being mounted to respective deflection rolls, said carrier means further including drive means connected to said respective deflection rolls for moving said driving belts synchronously over said respective deflection rolls.

14. The assembly defined in claim 1, further comprising means connected to at least one of said first lifting table and said second lifting table for adjusting the vertical position thereof so that the uppermost workpiece in said respective one of said first stack and said second stack is disposed in a predetermined plane.

15. The assembly defined in claim 1 wherein at least one of said first separating device and said second separating device includes means comprising at least one air nozzle for ejecting an air stream laterally towards the respective one of said first stack and said second stack to facilitate a separating of an uppermost workpiece in said respective one of said first stack and said second stack.

16. The assembly defined in claim 1 wherein at least one of said first separating device and said second separating device includes a lifting plate disposed over the respective one of said first stack and said second stack at the respective one of said first magazine station and said second magazine station, said one of said first separating device and said second separating device being provided on a downwardly facing side with a plurality of spaced finger-shaped gripper members, said gripper members being disposed in a linear array extending transversely to said linear configuration along a side, facing towards said delivery station, of said respective one of said first stack and said second stack, said one of said gripper members being shiftable along a line defined by said linear array.

17. The assembly defined in claim 16 wherein said respective one of said first stack and said second stack comprises several substacks of workpieces all have a similar contour, workpieces in each of said substacks having a common size different from sizes of the workpieces in other ones of said substacks, the workpieces in any given one of said substacks having a size smaller than the sizes of workpieces in substacks disposed below said given one of said substacks and a size larger than the sizes of workpieces in substacks disposed above said given one of said substacks, all of the workpieces in said substacks having a like edge engaging a common stop, said one of said gripper members being disposed at a distance from said stop greater than distances at which others of said gripper members are disposed with respect to said stop.

18. The assembly defined in claim 17 wherein each of said substacks is covered with a respective template having a contour identical to the contour of the respective substack and further having on an upper surface an at least partially light reflective region, further comprising a light scanning device disposed on said one of said gripper members, said light scanning device being mounted to direct a beam of light downwardly onto said respective one of said first stack and said second stack.

19. The assembly defined in claim 1 wherein said foil is stretched.

20. The assembly defined in claim 1 whrein said foil is made of polytetrafluoroethylene.

* * * * *